US005492239A

United States Patent [19]

Yen

[11] Patent Number: 5,492,239

[45] Date of Patent: Feb. 20, 1996

[54] GARBAGE CAN AND LID ASSEMBLY

[76] Inventor: Fong-Chen Yen, No. 22, Jong-Juang Tzyy, Jea-Jong Tsuen, Shiah-Yng Shiang, Tainan Shien, Taiwan

[21] Appl. No.: 349,565

[22] Filed: Dec. 2, 1994

[51] Int. Cl.[6] ..... B65D 43/26; B65F 1/00

[52] U.S. Cl. ..... 220/263; 220/908

[58] Field of Search ..... 220/260, 262, 220/263, 340, 343, 908; 254/385, 386

[56] References Cited

U.S. PATENT DOCUMENTS

| | | | |
|---|---|---|---|
| 1,028,898 | 6/1912 | Moran | 220/908 X |
| 2,546,915 | 3/1951 | Yerkes | 220/264 |
| 4,558,799 | 12/1985 | Hammond | 220/908 X |
| 5,170,904 | 12/1992 | Neuhaus | 220/908 X |
| 5,292,023 | 3/1994 | Yen | 220/908 X |

*Primary Examiner*—Allan N. Shoap
*Assistant Examiner*—Nathan J. Newhouse
*Attorney, Agent, or Firm*—Bacon & Thomas

[57] ABSTRACT

A garbage can and lid assembly comprising a can body and a lid frame placed on the can body and two half lids pivotally secured to the lid frame to close and open an upper opening of the lid frame by a handle slidably combined with the lid frame and pushed down to pull two ropes connected with one end of each of the two half lids for opening. The two half lids swinging down by their own weight to close the opening of the lid frame by releasing the handle after it has been pushed down.

6 Claims, 5 Drawing Sheets

GARBAGE CAN AND LID ASSEMBLY

BACKGROUND OF THE INVENTION

1. Field of the Invention

This invention concerns a garbage can, particularly one having a lid able to be opened by pushing down a handle and to be closed by releasing the handle.

2. Description of the Prior Art

A known conventional garbage shown in FIG. 1 comprises a can body 10, a stationary half lid 11 placed on the can body 10 and a movable half lid 12 mounted to move out of and into the stationary half lid 11 for opening and closing the upper opening of the can body 10. In using this conventional garbage can, the movable half lid 12 is first grasped by a hand and swung into and under the stationary half lid 11 for garbage to be thrown into the can body 10. Thereafter, movable half lid is grasped and pulled to dose the upper opening of the can body 10 again. However, the upper opening of the can body 10 is not large, so garbage may contact the movable half lid 12 if the garbage is carelessly thrown into the can body 10. In addition, the half lid 12 may become soiled during grasping. This conventional garbage can is considered to have the following disadvantageous.

1. In use, a hand of the user is required to grasp the movable half lid in opening and closing it. This is not so convenient and may easily soil the hand and the lid.
2. The can body 10 and the stationary lid 11 are not stably secured together. Thus, permitting garbage to fall out of the can body and scatter around, creating an unhealthy environment.

SUMMARY OF THE INVENTION

A main object of the present invention is to offer a garbage can having a lid able to be closed and opened by pushing a handle without using a hand to directly grasp the lid, and at the same time to prevent garbage from falling out of the can body.

A garbage can in the present invention has a can body with plural hooks on its circumferential edge, a lid frame placed on the upper circumferential edge of the can body and having plural latches to engage the hooks of the can body to keep the lid frame stable with the can body. Two half lids are provided for closing and opening an opening of the lid frame by a handle which is pushed down to pull two ropes which in turn pull the two half lids to swing up to the tight and the left, thus opening the can for garbage to be thrown into the can body. If the handle is released after throwing the garbage, the two half lids can swing down to close the opening under their own weight by means of pivots in the form of pin-shaped projections of the lids fitting in pin holes of the lid frame. The handle has a rectangular passageway for receiving a projection on a rear vertical wall of the lid frame so that the handle can be moved up and down by a combination of the passageway and the projection to attain opening and closing of the lids. The two ropes are bound between the lower end of the handle and tings on a rear side of the two lids and guided by two pulleys.

DETAILED DESCRIPTION OF THE INVENTION

Figure 1:
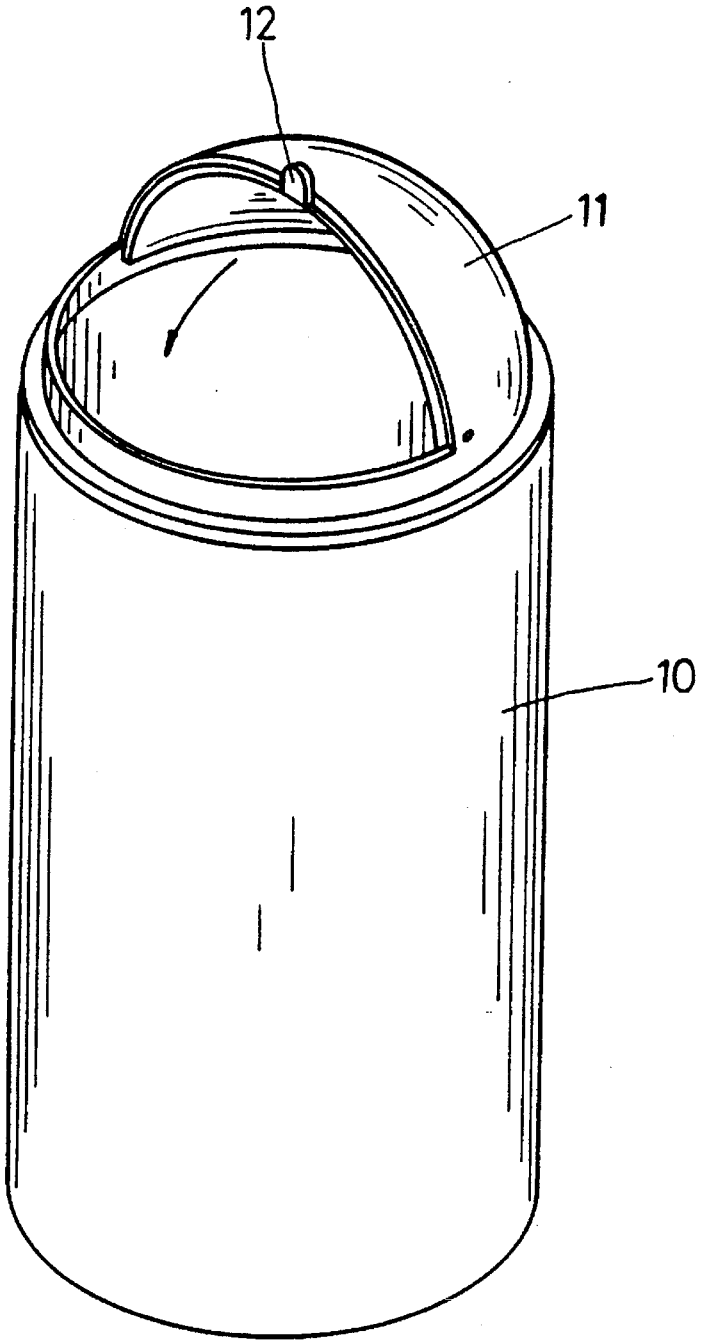
FIG. 1 (PRIOR ART)
FIG. 1 is a perspective view of a known conventional garbage can.
Figure 2:
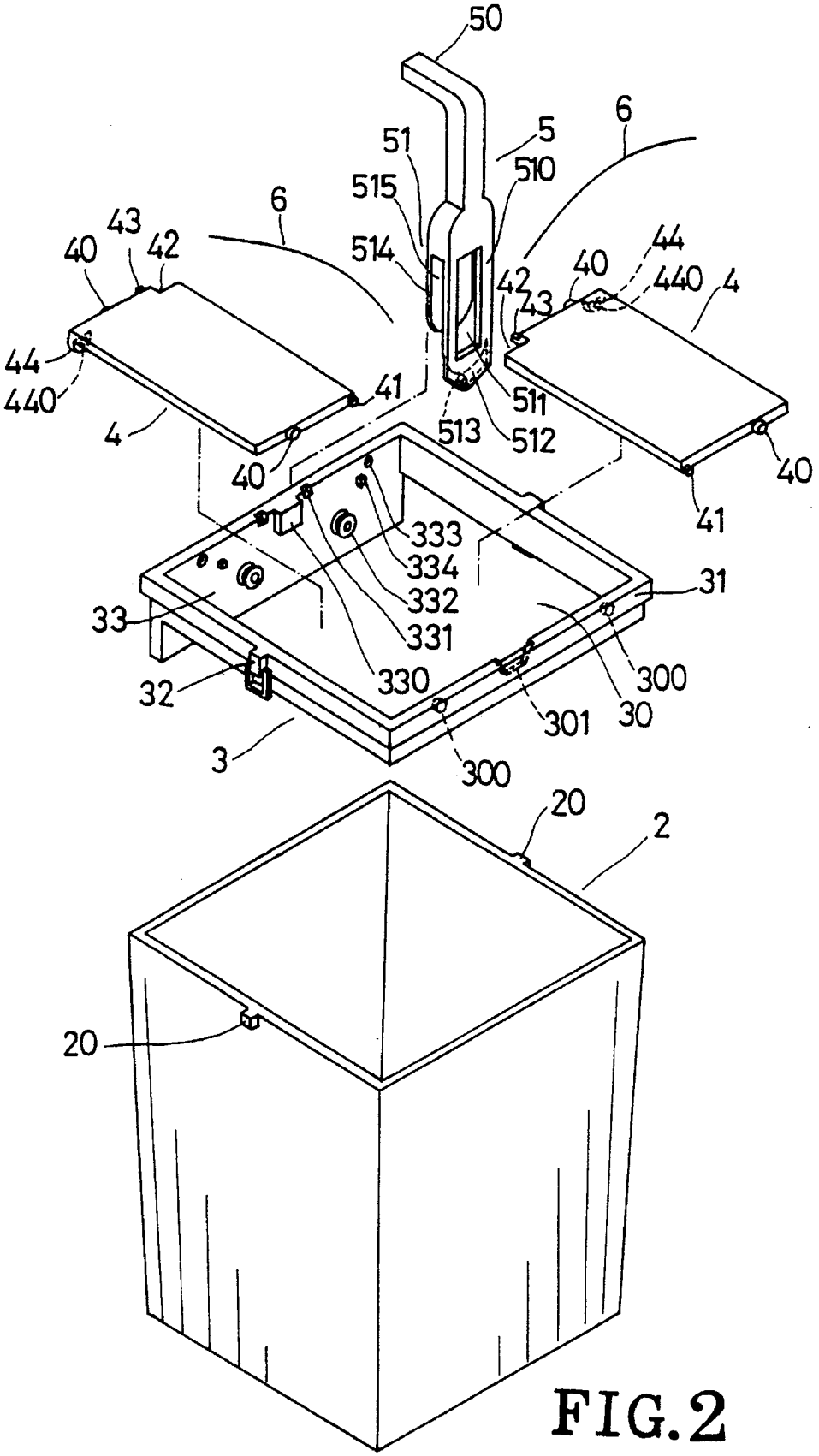
FIG. 2 is an exploded perspective view of a garbage can of the present invention.

A garbage can in the present invention, as shown in FIG. 2, comprises a can body 2, a lid frame 3, two half lids 4, 4, a handle 5 and two ropes 6, 6 as the main combined components.

The can body 2 has two opposed hooks 20, 20 on two opposite sides of an upper peripheral edge.

The lid frame 3 is configured to fit on the upper peripheral edge of the can body 2, and includes an opening 30, a circumferential outwardly projecting stop edge 31 surrounding the opening 30, a key latch 32 on each of two opposite sides to engage the two hooks 20, 20 of the can body 2, a vertical rear side wall 33 extending down from the stop edge 31, a rectangular projection 330 provided at an inner upper middle portion of the vertical rear side wall 33, a notch 331 provided at each of two sides of the projection 330, a pulley 332 provided respectively below each of the two notches 331, 331, a pin hole 333 provided respectively under the upper peripheral edge adjacent two corners along the inner side of the rear side wall 33, a locating projection 334 provided respectively below each pin hole 333, a pair of pin holes 300 respectively provided in an inner wall of a front side of the stop edge 31 to correspond to the two pin holes 333 of the rear side wall 33, and a crown-shaped notch 301 in the middle of the front side of the stop edge 31.

The two half lids 4, 4 are to be combined with the lid frame 3, with each lid 4 being shaped as a flat board and includes a pin-shaped sidewise projection 40 respectively on the front edge and the rear edge adjacent an outer lengthwise side, a stop projection 41 provided respectively at an inner corner of the front edge, a notch 42 provided at the inner corner of the rear edge, a stop projection 43 provided adjacent the notch 42 of the rear edge, and a connecting ring 44 with a hole 440 provided at the outer corner of the rear edge.

The handle 5 is combined with the middle projection 330 of the lid frame 3 and includes an upper bent grip 50, and an inverted U-shaped connecting portion 51 extending down from the grip 50. The inverted U-shaped connecting portion 51 has a slidable board 510 and a stop board 514 forming two parallel sections, with the slidable board 510 being longer than the stop board 514. The slidable board 510 has a rectangular passageway 511, a triangular end 512, and a sideways projection 513 on the end 512 having a height equal to the thickness of the slidable board 510. A deep aperture 515 is defined between the slidable board 510 and the stop board 514.

The two ropes 6, 6 each have one end secured to the sideways projection 513 of the handle 5 and their other ends secured to the two rings 44 of the two half lids 4,4.

Figure 3:
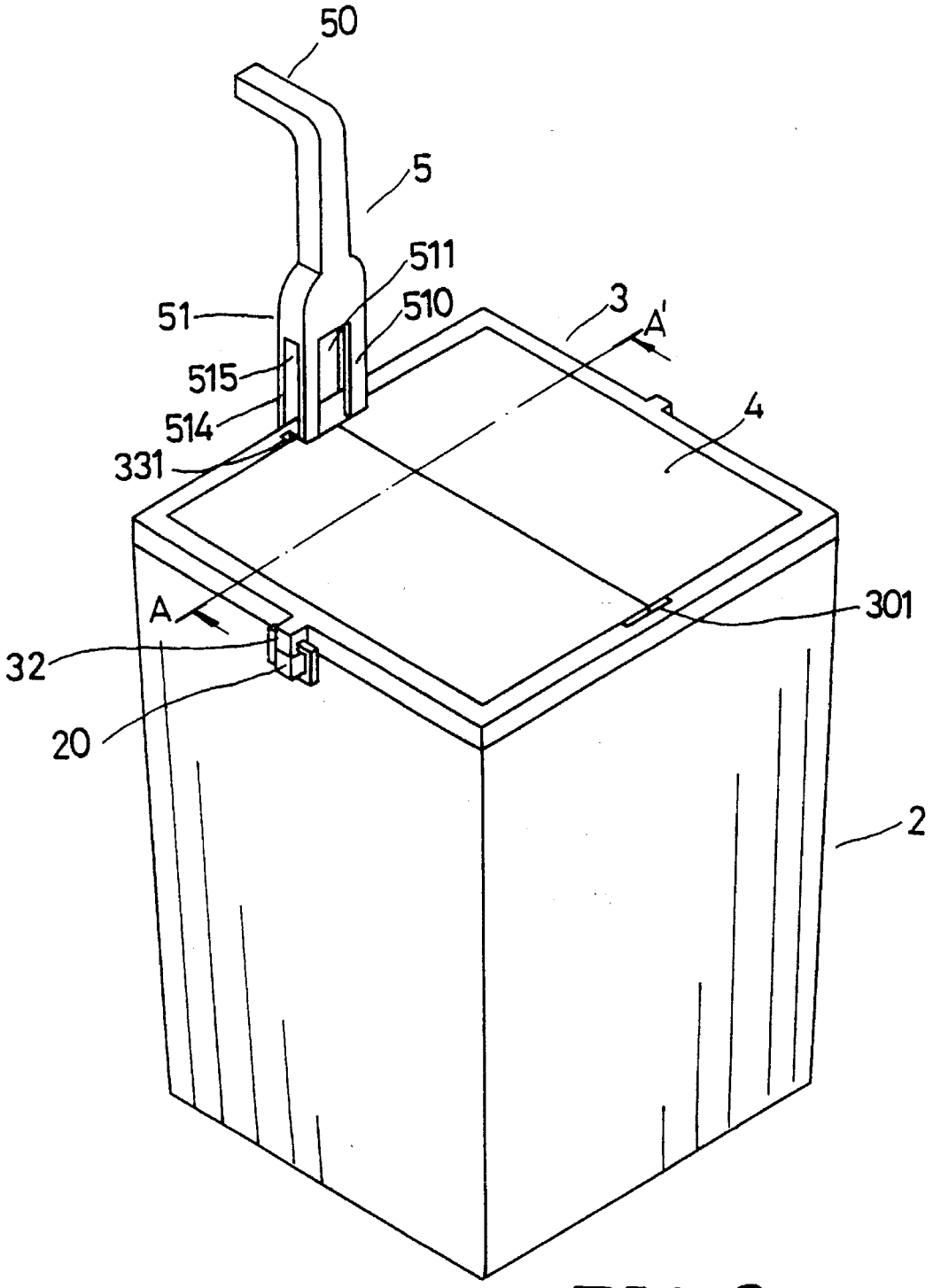
FIG. 3 is an assembled perspective view of the garbage can of the present invention.
Figure 4:
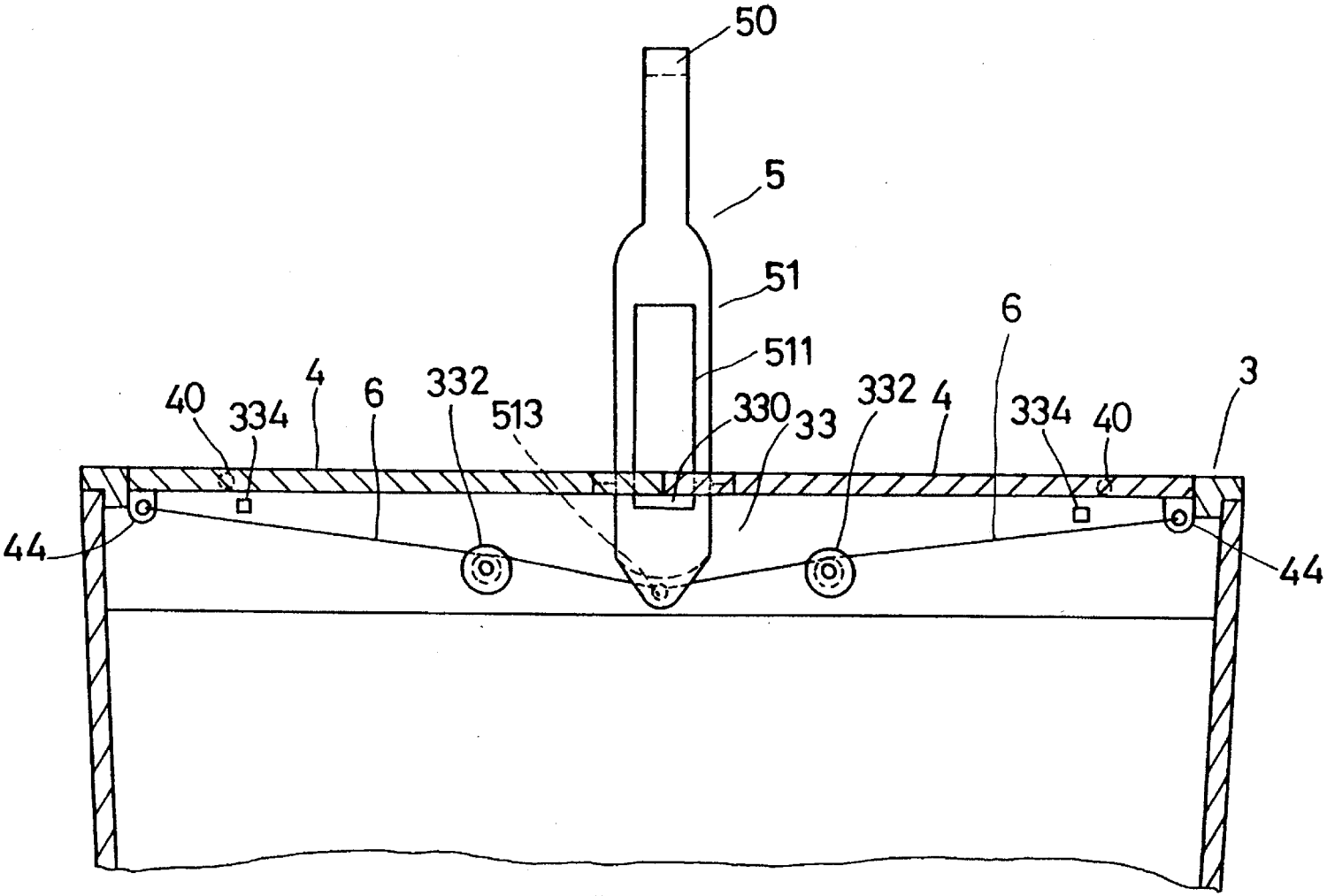
FIG. 4 is a partial cross-sectional view along the line A—A of FIG. 3, showing the two half lids in a closed condition.

In assembling, referring to FIGS. 2, 3 and 4, the lid frame 3 is placed on the can body 2, with the stop edge 31 lying on the upper edge of the can body 2, and with the two key latches 32 engaging the two hooks 20, 20 of the can body 2. Then one end of the two ropes 6, 6 are secured to the projection 5 13 of the connecting portion 51 of the handle 5, and the rectangular passageway 511 of the connecting portion 51 is disposed around the middle projection 330 of the rear wall 33 of the lid frame 3. Then the other ends of the ropes 6, 6 are secured to the rings 44, 44 of the two half lids 4, 4, and engage the pulleys 332, 332. The two pin-shaped projections 40, 40 of each of the two half lids 4, 4, are engaged within the pin holes 300, 300, 333, 333 of the lid frame 3. And finally, the two half lids 4, 4, are placed to close the opening 30 of the lid frame 3, with the stop projections 41, 43 respectively engaged within the notches 301,331,331 of the lid frame 3.

Figure 5:
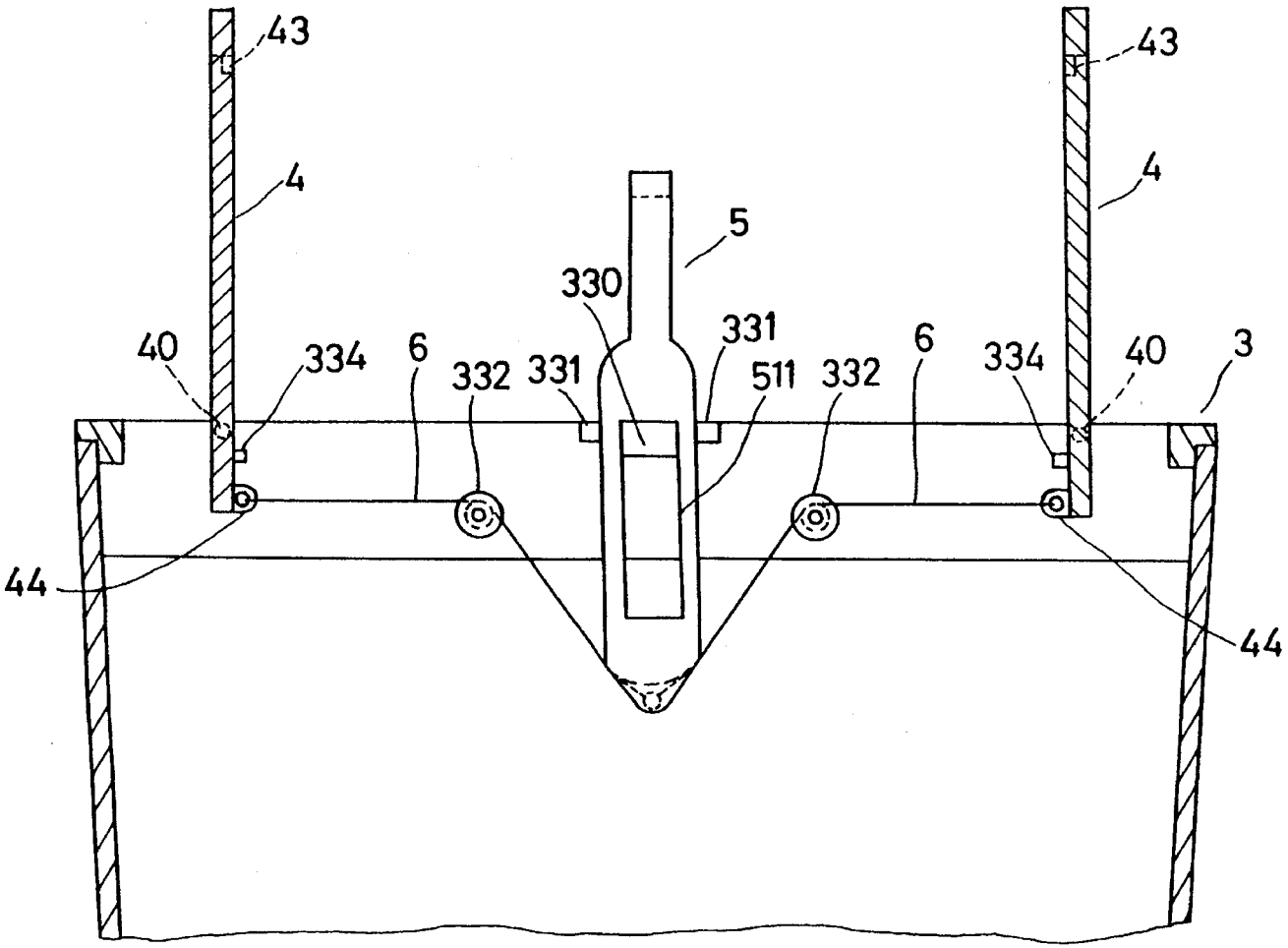
FIG. 5 is a partial cross-sectional view of the two half lids in an opened condition.

In use, referring to FIGS. 3 and 4, the handle 5 is manually pushed down, forcing the passageway 511 to slide down along the two opposite sides of the middle projection 330 of the rear vertical wall 33, with the deep aperture 515 also sliding along the projection 33, until the top of aperture 515 is stopped by the upper edge of the rear vertical wall 33. Meanwhile, the handle 5 pushes down the ropes 6,6 which move down to pull the two rings 44, 44 of the two half lids 4,4 towards the two pulleys 332, 332, moving and sliding on the pulleys 332, 332 with little friction. This causes the two half lids 4, 4 to be swung up to the right and the left, with the pin-shaped projections 40 as pivots, as shown in FIG. 5. And when the lower inner surfaces of the two half lids 4, 4 contact with the locating projections 334, 334, the two half lids 4, 4 are stopped and opened to the largest degree, enabling garbage to be thrown into the can body 2.

After garbage has been thrown in the can body 2, and upon release of handle 5, the two half lids 4, 4 swing back down under their own weight and the eccentric positions of the pivots at projection 40, thereby completely closing the opening 30 of the lid frame 3. Meanwhile, the two ropes 6, 6 are pulled by the rings 44, 44, forcing the handle 5 to move up to its original position, until the bottom side of the passageway 511 engages the middle projection 330, and the stop projections 41, 43 respectively reengaging their corresponding notches 301, 331, 331.

What is claimed is:

1. A garbage can and lid assembly comprising:

a) a can body for receiving garbage and having an open top defined by an upper peripheral edge;

b) a frame engageable with the open top of the can body, the frame including an opening for depositing garbage into the can body, an outwardly extending circumferential edge engageable with the peripheral edge of the can body, a rear vertical wall extending downwardly from the circumferential edge and including an inner surface, and a middle projection extending inwardly from the inner surface;

c) a handle including an upper portion forming a grip and a lower portion having an inverted U-shaped configuration defined by a slidable board and a stop board, a passageway formed in the slidable board, the lower portion slidably engageable on the circumferential edge and the rear vertical wall of the frame, with the middle projection disposable within the passageway;

d) a pair of half lids and means for pivotally mounting the lids to the frame to open and close the frame opening; and e) rope means connecting the half lids and engageable by the handle, whereby pushing the handle downwardly towards the frame causes the half lids to pivot upwardly into an open position, and releasing the handle causes the half lids to pivot downwardly into a closed position and return the handle upwardly to its original position.

2. The assembly of claim 1 further including means for securing the frame to the garbage can, said securing means includes a pair of opposed hooks mounted on the peripheral edge of the can body and a pair of opposed latches mounted on the frame.

3. The assembly of claim 1 wherein the frame further includes a front side having an inner face and the means for pivotally mounting the half lids to the frame includes:

a) a pair of pin holes in the inner surface of the rear vertical wall and a pair of pin holes in the inner surface of the front side; and b) a pair of outwardly projecting pins on opposite sides of each of the half lids, and the pins being received within the pin holes for pivotal movement.

4. The assembly of claim 3 wherein:

a) the frame further includes notches means formed in the rear vertical wall and the front side; and b) the half lids each includes projections at opposed sides thereof for engaging the notches means when the half lids are in their closed position.

5. The assembly of claim 3 further including:

a) a pair of spaced pulleys provided on the inner surface of the rear vertical wall, with the rope means engaging the pulleys;

b) a pair of spaced locating projections disposed adjacent the pin holes in the inner surface of the rear vertical wall for limiting the pivotal movement of the half lids while being disposed in their open position and to permit the half lids to close under their own weight; and c) the half lids are each of a substantially rectangular configuration, and the projections extend outwardly from the shorter sides of each lid and are eccentrically positioned adjacent a longer side thereof.

6. The assembly of claim 1 wherein the slidable board of the handle includes a triangular-shaped terminal end, the terminal end includes a sideway projection having a height equal to the thickness of the slidable board, and the rope means is secured to the sideway projection.

* * * * *